United States Patent [19]

Kato

[11] Patent Number: 4,721,090

[45] Date of Patent: Jan. 26, 1988

[54] BLOW-BY GAS RECIRCULATING APPARATUS

[75] Inventor: Hisashi Kato, Tokyo, Japan

[73] Assignee: Honda Giken Kogyo Kabushiki Kaisha, Tokyo, Japan

[21] Appl. No.: 869,435

[22] Filed: Jun. 2, 1986

[30] Foreign Application Priority Data

Jun. 3, 1985 [JP] Japan ..... 60-120245

[51] Int. Cl.[4] ..... F02M 25/06

[52] U.S. Cl. ..... 123/572; 123/41.86

[58] Field of Search ..... 123/41.86, 572, 573

[56] References Cited

U.S. PATENT DOCUMENTS

| | | | |
|---|---|---|---|
| 3,673,997 | 7/1972 | Sawada | 123/572 |
| 3,731,665 | 5/1973 | Garcea | 123/572 |
| 3,908,617 | 9/1975 | Partridge | 123/41.86 |
| 4,517,951 | 5/1985 | Otaka | 123/572 |
| 4,565,164 | 1/1986 | Satoh | 123/572 |
| 4,597,372 | 7/1986 | Furukawa | 123/572 |
| 4,607,604 | 8/1986 | Kanoh | 123/572 |

*Primary Examiner*—Ronald B. Cox

*Attorney, Agent, or Firm*—Lyon & Lyon

[57] ABSTRACT

A blow-up gas recirculating apparatus for returning blow-by gases from the crankcase of an internal combustion engine to an intake passage thereof includes a shield panel attached to a cylinder head cover in substantially covering relating to a DOHC valve mechanism housed in a cylinder head. A breather chamber is defined between the cylinder head cover and the shield panel and communicates with the interior of the cylinder head and an air intake unit, such as an air cleaner, of the internal combustion engine. The breather chamber comprises first through third breather chamber sections interconnected by constricted passages, While blow-by gases are flowing through the breather chamber, an oil mist can reliably be separated from the blow-by gases.

9 Claims, 8 Drawing Figures

BLOW-BY GAS RECIRCULATING APPARATUS

BACKGROUND OF THE INVENTION

The present invention relates to an apparatus for recirculating the blow-by gases in the crankcase of an internal combustion engine back to an air-mixture intake passage such as an intake manifold.

When the fuel is ignited and exploded in an engine combustion chamber, gases are produced therein and the pressure in the combustion chamber is increased. Some of the gases are forced under the increased pressure to flow through the gap between the piston and the cylinder wall into the crankcase. As this process is repeated during operation of the engine, these blow-by gases are accumulated to develop a high pressure in the crankcase and caused to leak between the crankcase and the oil pan into the atmosphere as undesired air pollutants.

To solve the above problem, there have been employed blow-by gas recirculating apparatus, known as a positive crankcase ventilation (PCV) system, for guiding unburned gases that have leaked into the crankcase back to the combustion chamber as blow-by gases and introducing air into the crankcase for crankcase ventilation.

Some blow-by gas recirculating apparatus include a breather chamber disposed in the cylinder head and connected to the air cleaner. During engine operation, air is supplied via the breather chamber into the crankcase.

In such blow-by gas recirculating apparatus, the pressure in the air cleaner is lower than that in the breather chamber while the engine is rotating at high speeds, causing blow-by gases to flow from the breather chamber into the air cleaner. The blow-by gases contain a large amount of oil mist as well as unburned gases, and such oil mist would be attached to the filter element in the air cleaner, thus contaminating the air filter.

U.S. Pat. No. 4,156,406 issued on May 29, 1979 discloses a gas-oil separator for separating oil and contaminants from gas-oil mixtures in an internal combustion engine. U.S. Pat. No. 4,345,573 issued on Aug. 24, 1982 discloses a blow-by gas treating and controlling system.

SUMMARY OF THE INVENTION

It is an object of the present invention to provide a blow-by gas recirculating apparatus including a breather chamber capable of separating gases including unburned gases from an oil mist.

According to the present invention, there is provided a blow-by gas recirculating apparatus for returning blow-by gases from the crankcase of an internal combustion engine to an intake passage thereof, the blow-by gas recirculating apparatus including a cylinder head, a cylinder head cover mounted on the engine cylinder head, a DOHC valve mechanism housed in the cylinder head, a shield panel attached to the cylinder head cover in substantially covering relation to the DOHC valve mechanism, and a breather chamber defined between the cylinder head cover and the shield panel and communicating with the interior of the cylinder head and an air intake unit, such as an air cleaner, of the internal combustion engine.

The breather chamber comprises first through third breather chamber sections interconnected by constricted passages. Therefore, while blow-by gases are flowing through the breather chamber, an oil mist can reliably be separated from the blow-by gases. Oil and gases including unburned gases can efficiently be separated even when the amount of blow-by gases is increased in case the engine of a larger displacement is employed. The breather chamber is relatively large in volume or capacity, and contains a gas layer. Therefore, it can minimize a temperature rise on the surface oaf the cylinder head cover, and sounds transmitted from the cylinder head can be attenuated by the gas layer in the breather chamber. The large-volume breather chamber is less subject to influences due to the temperature of the outer surface of the cylinder head cover. Even when the ambient air is of a low temperature, therefore, the passages in the breather chamber are less likely to be frozen. Where the cylinder head cover is formed of an aluminum alloy and the shield plate is formed of a steel sheet, the breather chamber can be kept at a high temperature by the difference between the heat capacities of these different materials. As a result, water and unburned fuel in the blow-by gases can be evaporated effectively for quick and reliable separation from the oil mist.

The above and another objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
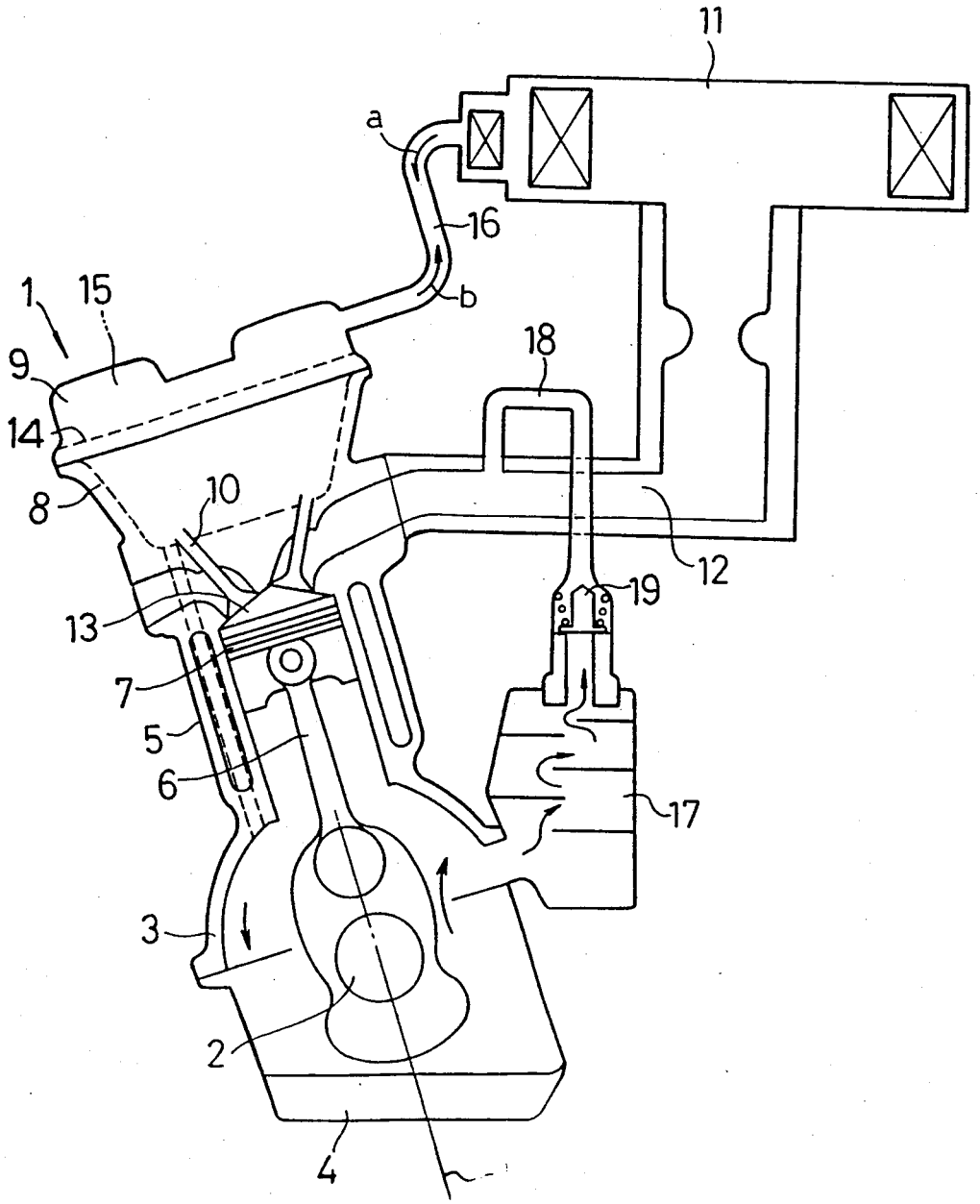
FIG. 1 is a schematic front elevational view of an internal combustion engine incorporating a blow-by gas recirculating apparatus according to the present invention.

FIG. 1 schematically shows an internal combustion engine, generally denoted by the reference numeral 1, in which a blow-by gas recirculating apparatus of the invention is incorporated. The engine 1 has its cylinder axis N inclined to the vertical line. The engine 1 includes a crankcase 3 in which a crankshaft 2 is rotatably accommodated, an oil pan 4 attached to the bottom of the crankcase 3, a cylinder block 5 on the top of the crankcase 3, pistons 7 (only one shown in FIG. 1) slidably disposed in the cylinder block 5 and operatively connected to the crankshaft 2 by a connecting rod 6, a cylinder head 8 mounted on the upper end of the cylinder block 5, a cylinder head cover 9 mounted on the top of the cylinder head 8, and a valve mechanism 10 of the DOHC (double overhead cam) type housed in the cylinder head 8. The crankcase 3, the cylinder block 5, the cylinder head 8, and the cylinder head cover 9 are cast of an aluminum alloy.

An air cleaner case 11 is positioned upwardly and laterally of the engine 1. Fresh and cleaned air supplied from the air cleaner case 11 is delivered through an intake manifold 12 to combustion chambers 13 (only one shown in FIG. 1) in the engine 1. The air cleaner 11 is connected by a tube 16 to a breather chamber 15 of a relatively large volume or capacity defined longitudinally in the cylinder head cover 9 by a shield panel 14.

A trap chamber 17 is attached to a side of the crankcase 3. Upwardly from the trap chamber 17, there extends a blow-by gas supply pipe 18 connected to the intake manifold 12. The blow-by gas pipe 18 houses therein a PCV (positive crankcase ventilation) valve 19 for controlling the amount of blow-by gases supplied to the intake manifold 12 dependent on the difference between the pressure in the intake manifold 12 and the pressure in the crankcase 3.

When the engine 1 rotates in a low- or medium-speed range, the blow-by gases from the crankcase 3 and fresh air fed from the air cleaner case 11, as indicated by the arrow a, pass through the breather chamber 15 into the crankcase 3 and flow into the trap chamber 17 in which the oil mist is separated from the blow-by gases. Then, the blow-by gases flow through the PCV valve 19 into the intake manifold 12, in which the gases are mixed with an air-fuel mixture. The mixture is then supplied to the combustion chambers 13.

During high-speed rotation of the engine 1, vacuum is developed in the air cleaner case 11, and some of the blow-by gases in the crankcase 3 are forced to flow through the breather chamber 15 into the air cleaner case 11, as indicated by the arrow b.

Figure 2:
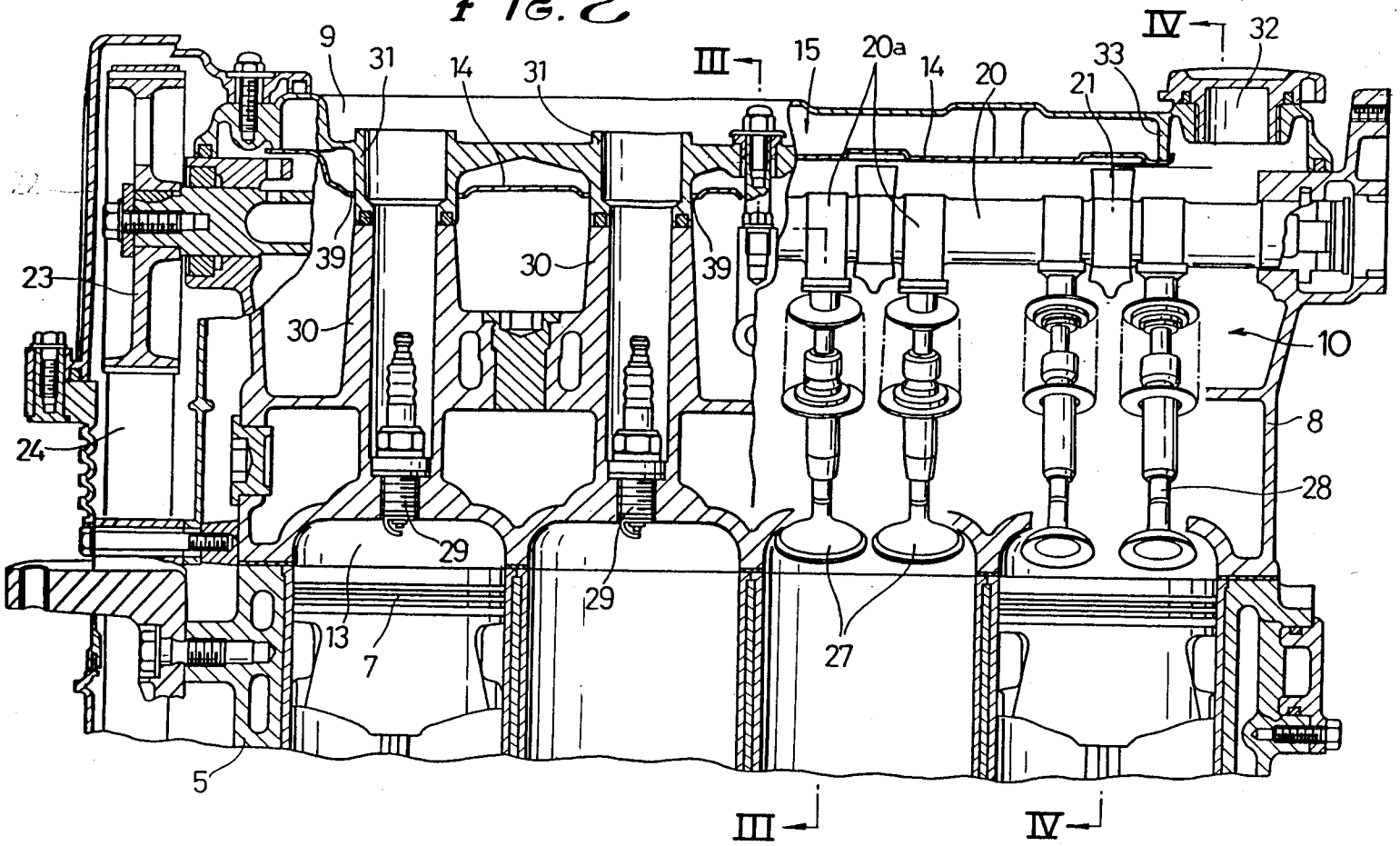
FIG. 2 is an enlarged longitudinal cross-sectional view of the engine shown in FIG. 1.
Figure 3:
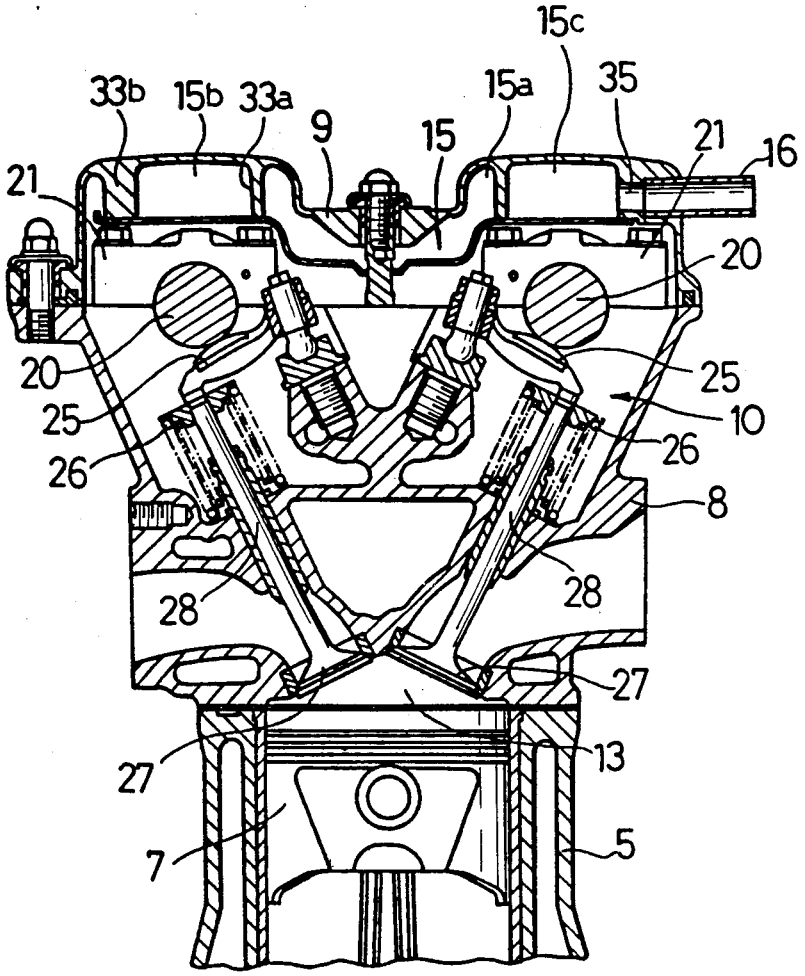
FIG. 3 is a cross-sectional view taken along III—III of FIG. 2.
Figure 4:
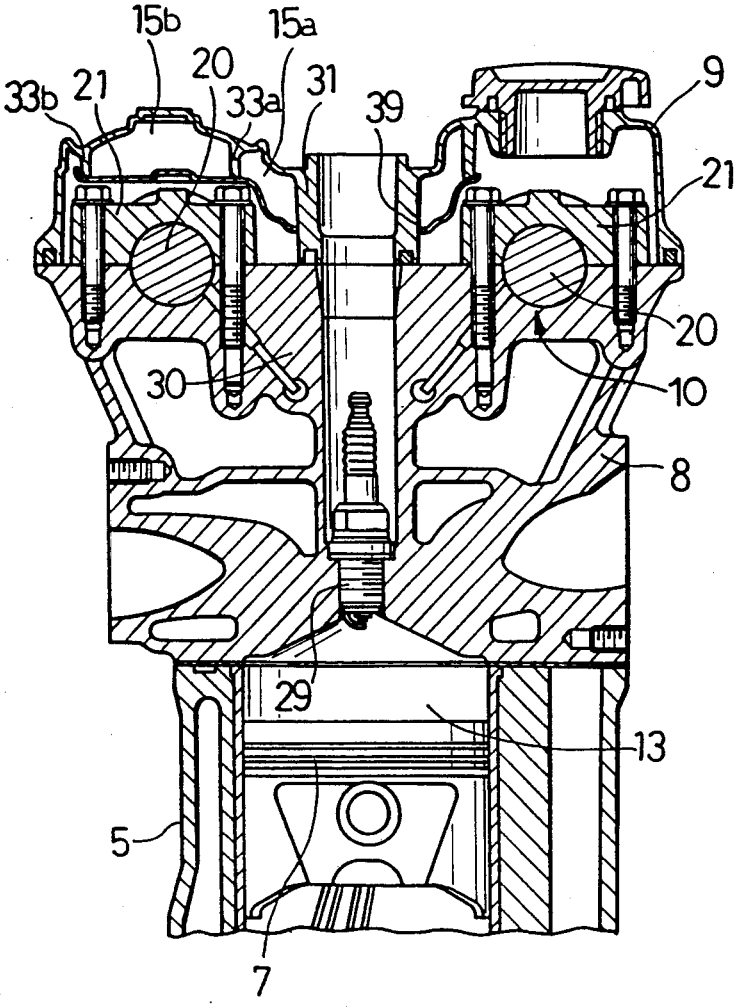
FIG. 4 is a cross-sectional view taken along IV—IV of FIG. 2.

FIGS. 2 through 4 illustrate the upper structure of the engine 1 in the cross section. The DOHC valve mechanism 10 includes two cam shafts 20 rotatably supported by respective bearings 21 in an upper portion of the cylinder head 8. The cam shafts 20 have one end disposed in a case 22 (FIG. 2) attached to an end of the engine 1. Gears 23 are fixedly mounted on the respective ends of the cam shafts 20 in the case 22. The gears 23 are operatively coupled by timing belts 24 to a gear (not shown) fixedly mounted on the crankshaft 2 so that the crankshaft 2 and the cam shafts 20 will rotate in synchronism. The cam shafts 20 have cam surfaces **20*a* slidably held against respective rocker arms 25 (FIG. 3) engaging the upper ends of valve stems 28 of valves 27 that are normally urged upwardly by respective springs 26. Therefore, the valves 27 are caused to be opened and closed in synchronism with rotation of the crankshaft 2. The valve mechanism 10 is composed primarily of the cam shafts 20, the rocker arms 25, the springs 26, and the valve stems 28**.

The cylinder head 8 has a central array of tubular plug housings 30 in which respective ignition plugs 29 are disposed. The cylinder head cover 9 also has a central array of vertical plug access tubes 31 held in registry with the tubular plug housings 30, respectively.

The cylinder head cover 9 has an oil supply inlet 32 (FIG. 2) at one end remote from the case 22. The cylinder head cover 9 also has an integral rib or partition 33 projecting downwardly from the underside thereof. The shield panel 14 is held against the lower end of the rib 33 in covering relation to th valve mechanism 10.

The cylinder head cover 9 and the shield panel 14 which jointly define the breather chamber 15 will be described below in detail with reference to FIGS. 5 through 8.

Figure 5:
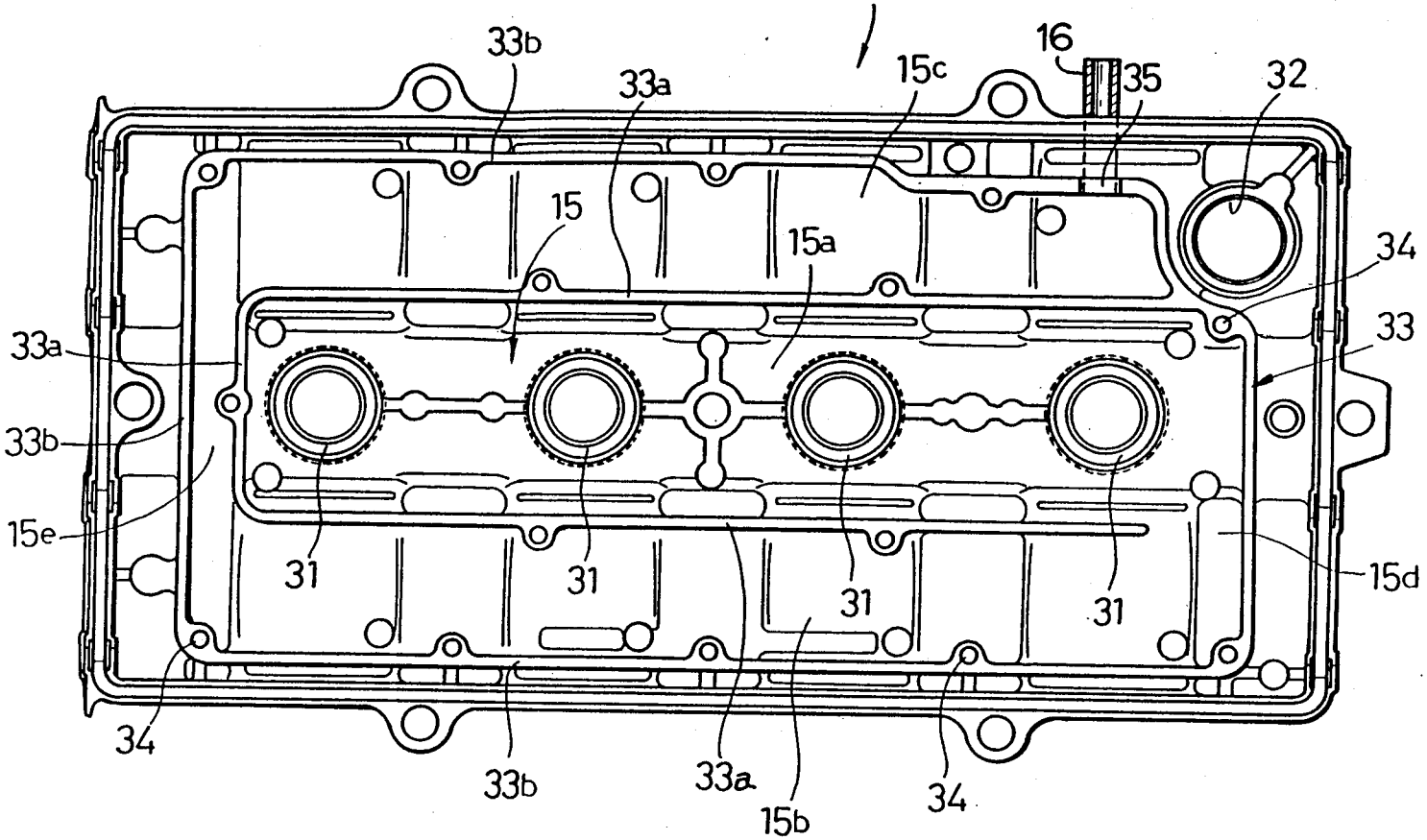
FIG. 5 is a bottom view of a cylinder head cover of the engine of FIG. 1.

As shown in FIG. 5, the plug access tubes 31 (there are four plug access tubes in the illustrated embodiment) are spaced longitudinally on the cylinder head cover 9. A rib 33 projecting downwardly from the inside of cover 9 includes an inner rib member **33*a* extending around the plug access tubes 31 and an outer rib member 33*b* extending around the inner member 33*a* in spaced relation thereto along the peripheral edge of the cylinder head cover 9. These inner and outer rub members 33*a*, 33*b* divide the breather chamber 15 into a first central breather chamber section 15*a*, a second side breather chamber section 15*b*, a third side breather chamber section 15*c*, and constricted passages 15*d*, 15*e* by which the first through third breather chamber sections 15*a*, 15*b*, 15*c* are interconnected. More specifically, the inner rib member 33*a* defines the first breather chamber section 15*a* therein, and the outer rib member 33*b* defines the second the third breather chamber sections 15*b*, 15*c* around the inner rib member 33*c*. The second and third breather chamber sections 15*b*, 15*c* are positioned one on each side of the first breather chamber section 15*a*. The rib 33 has threaded holes 34 in which screws (now shown) are threaded to attach the shield panel 14 to the rib 33. The outer rib member 33*b* has a hole 35 (also shown in FIG. 3) through which the third breather chamber section 15*c* communicates with the air cleaner case 12 via the tube 16**.

Figure 6:
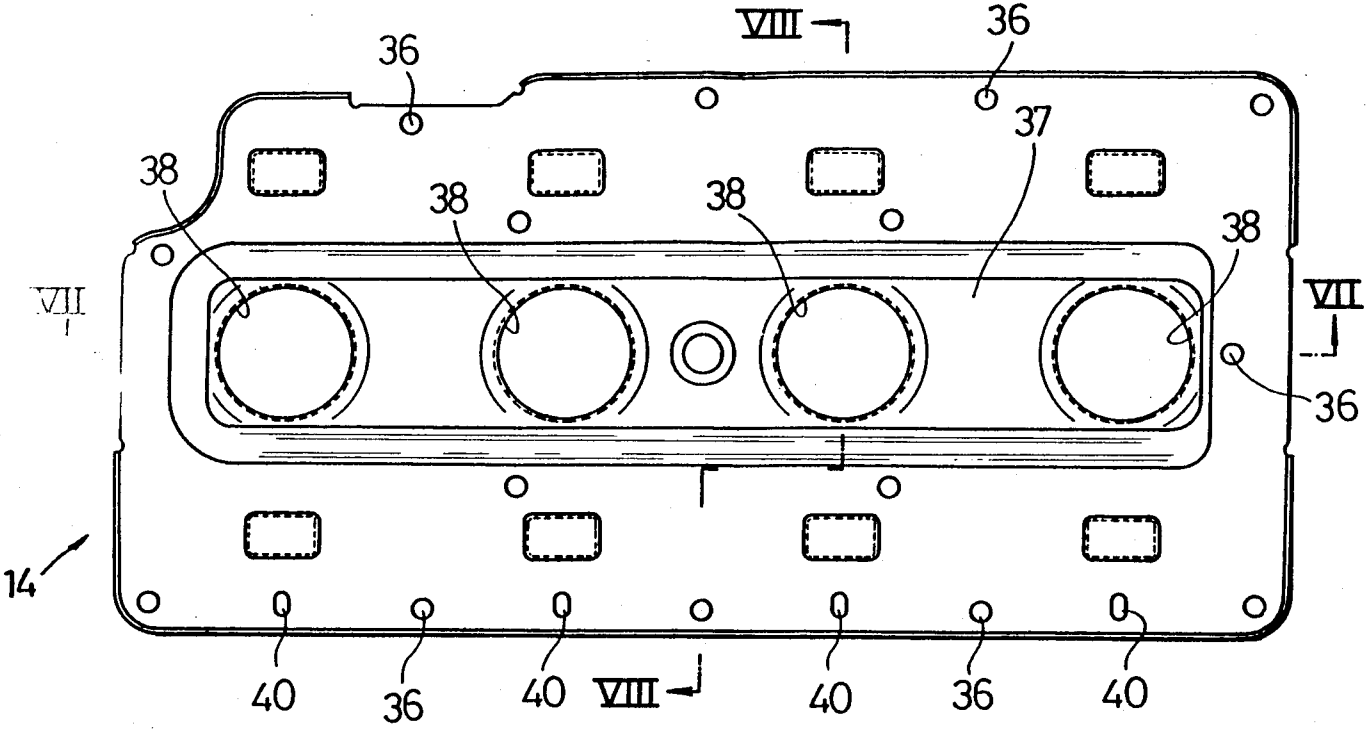
FIG. 6 is a plan view of a shield panel of the engine of FIG. 1.
Figure 7:
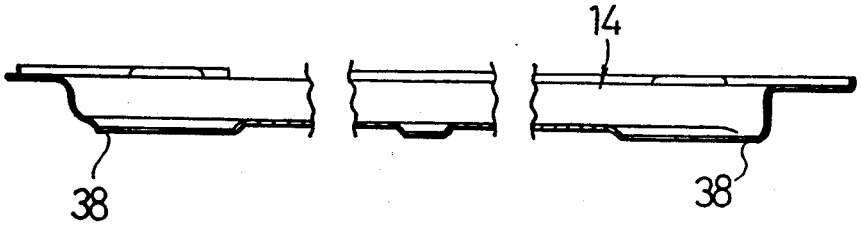
FIG. 7 is a cross-sectional view taken along line VII—VII of FIG. 6.
Figure 8:
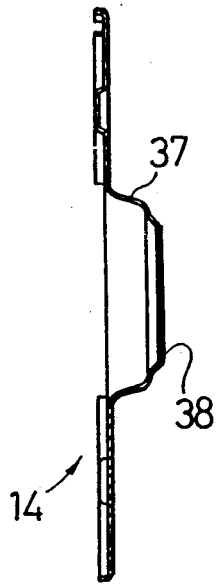
FIG. 8 is a cross-sectional view taken along line VIII—VIII of FIG. 6.

FIGS. 6 through 8 illustrate the shield panel 14, which is formed of a steel sheet or the like. The shield panel 14 is of such a size as to cover about 80% of the entire area of the underside of the cylinder head cover 9. The shield panel 14 has attachment holes 36 registering with the threaded holes 34, respectively. The shield panel 14 includes a central portion 37 bulging downwardly to partly define the first breather chamber section **15*a*. The central bulging portion 37 has circular holes 38 defined at spaced intervals in its bottom for passage of the respective plug access tubes 31 of the cylinder head cover 9. The circular holes 38 have a diameter larger than the outside diameter of the plug access tubes 31. With the shield panel 14 attached to the cylinder head cover 9, there are gaps or clearances 39 (FIGS. 2 and 4) defined between the plug access tubes 31 and the edges of the circular holes 38. These gaps 39 provide communication between the breather chamber 15 and the interior of the cylinder head 8 in which the valve mechanism 10** is accommodated.

The shield panel 14 has a plurality of oil return holes 40 defined near one side thereof which is in the lowermost position when the engine 1 is mounted on an automobile (not shown) with its axis N inclined to the vertical line, as shown in FIG. 1. These oil return holes 40 are positioned in the second breather chamber section **15*b*. With the engine axis N inclined, the second breather chamber section 15*b* is in a lower position whereas the third breather chamber section 15*c*** is in a higher position.

When the engine 1 rotates in a high-speed range, some of the blow-by gases in the crankcase 3 pass through the cylinder head 8 and the gaps 39 into the central section, i.e., the first breather chamber section **15*a*, of the breather chamber 15. The blow-by gases then flow from the first breather chamber section 15*a* to the constricted passage 15*d* to the second breather chamber section 15*b* to the constricted passage 15*e* to the third breather chamber section 15*c*, from which the blow-by gases flow through the hole 35 and the tube 16 into the air cleaner 11**.

While the blow-by gases are passing through the breather chamber sections 15*a*, 15*b*, 15*c* and the constricted passages 15*d*, 15*e*, they are repeatedly expanded and compressed, and flow at different speeds, i.e., at a high speed in the constricted passages 15*d*, 15*e* and at a low speed downstream of the constricted passages 15*d*, 15*e*. Therefore, an oil mist is reliably separated from the blow-by gases while they are flowing through the breather chamber 15. The blow-by gases from which the oil mist has been removed are then introduced into the air cleaner case 11.

Although a certain preferred embodiment has been shown and described, it should be understood that many changes and modifications may be made therein without departing from the scope of the appended claims.

I claim:

1. A blow-by gas recirculating apparatus for returning blow-by gases from the crankcase of an internal combustion engine to an intake passage thereof, comprising:

a cylinder head;

a cylinder head cover mounted on said engine cylinder head;

a DOHC valve mechanism housed in said cylinder head;

a shield panel attached to said cylinder head cover in substantially covering relation to said DOHC valve mechanism;

a breather chamber defined between said cylinder head cover and said shield panel and communicating with both the interior of said cylinder head and an air intake unit of the internal combustion engine;

said breather chamber extending longitudinally of said cylinder head cover and comprising a central first, second and third chamber sections each extending longitudinally substantially the full length of the cylinder head; and said second and third breather chamber sections being located one on each side of said first breather chamber section, said first through third breather chamber sections being interconnected by passages for causing blow-by gas passing from the interior of the cylinder head to flow longitudinally for substantially the entire length of the cylinder head cover through each of the first, second and third breather chambers, in that order, to the intake unit of the internal combustion engine.

2. A blow-by gas recirculating apparatus for returning blow-up gases from the crankcase of an internal combustion engine to an intake passage thereof, comprising;

a cylinder head;

a cylinder head cover mounted on said engine cylinder head;

a DOHC valve mechanism housed in said cylinder head;

a shield panel attached to said cylinder head cover in substantially covering relation to said DOHC valve mechanism;

a breather chamber defined between said cylinder head cover and said shield panel and communicating with the interior of said cylinder head and an air intake unit of the internal combustion engine;

said breather chamber extending longitudinally of said cylinder head cover and comprising a central first breather chamber section and second and third breather chamber sections which are located one on each side of said first breather chamber section, said first through third breather chamber sections being interconnected by passages; and said cylinder head cover having a substantially central array of plug access tubes, said shield panel having circular holes in which said plug access tubes extend, respectively, with gaps left therearound, said breather chamber communicating with the interior of said cylinder head through said gaps.

3. A blow-by gas recirculating apparatus according to claim 1, wherein each of said passages comprises a constricted passage.

4. A blow-by gas recirculating apparatus according to claim 1, wherein said engine is inclined with respect to a vertical line such that said second breather chamber section is lower in position than said third breather chamber section, said third breather chamber section communicating with said air intake unit, said shield panel having oil return holes positioned in said second breather chamber section.

5. A blow-by gas recirculating apparatus according to claim 1, wherein said cylinder head cover has a rib projecting from the underside thereof, said shield panel bearing held against and connected to said rib, said rib including inner and outer rib members dividing said breather chamber into said first through third breather chamber sections and said passages.

6. A blow-by gas recirculating apparatus for returning blow-by gases from the crankcase of an internal combustion engine to an intake passage thereof, comprising:

a cylinder head;

a cylinder head cover mounted on said engine cylinder head;

a DOHC valve mechanism housed in said cylinder head;

a shield panel attached to said cylinder head cover in substantially covering relation to said DOHC valve mechanism;

a breather chamber define between said cylinder head cover and said shield panel and communicating with the interior of said cylinder head and an air intake unit of the internal combustion engine;

said cylinder head cover having a rib projecting from the underside thereof, said shield panel bearing being held against and connected to said rib, and said rib including inner and outer rib members dividiing said breather chamber into said first through third breather chamber sections and said passages; and said cylinder head cover having a substantially central array of plug access tubes, said inner rib member extending around said plug access tubes and defining said first breather chamber section therein, said outer rib member extending around said inner rib member in spaced relation and defining said second and third breather chamber sections around said inner rib member.

7. A blow-up gas recirculating apparatus according to claim 6, wherein said shield panel has a substantially central bulging portion projecting toward said cylinder head and partly defining said first breather chamber section, said central bulging portion have an array of circular holes in which said plug access tubes extend, respectively.

8. A blow-by gas recirculating apparatus for returning blow-by gases from the crankcase of an internal combustion engine having an intake air passage and a cylinder head with an overhead cam mechanism, comprising a cylinder head cover for mounting on and enclosing a space above the cylinder head, a shield panel mounted on said cylinder head cover and extending across a substantial proportion of the space above the cylinder head, said cylinder head cover and shield panel having cooperating means forming a breather chamber therebetween with a lengthy blow-by gas path from inlet means to the cylinder head and outlet means for connecting to the intake air passage, the cylinder head cover and shield panel being of a substantial length in the direction of a plurality of engine cylinders in a line, and said lengthy blow-by gas path being defined in said breather chamber to cause the blow-by gas to flow substantially the full length of said shield panel at least twice.

9. A blow-by gas recirculating apparatus according to claim 1, wherein the cylinder head cover and shield panel are of a substantial length in the direction of a plurality of engine cylinders in a line and said blow-by gas path is defined in said breather chamber to cause the blow-by gas to flow the full length of said shield panel at least twice.

* * * * *